US012760480B1

(12) United States Patent
Vanaman

(10) Patent No.: US 12,760,480 B1
(45) **Date of Patent: *Oct. 13, 2026**

(54) BOTTOMLESS BRIDGE CONSTRUCTION SYSTEM AND METHOD

(71) Applicant: Andy Vanaman, Glenpool, OK (US)

(72) Inventor: Andy Vanaman, Glenpool, OK (US)

( * ) Notice: Subject to any disclaimer, the term of this patent is extended or adjusted under 35 U.S.C. 154(b) by 852 days.

This patent is subject to a terminal disclaimer.

(21) Appl. No.: 18/072,870

(22) Filed: Dec. 1, 2022

(51) Int. Cl.
*E01D 21/00* (2006.01)
*E01D 19/12* (2006.01)
*E01D 101/26* (2006.01)

(52) U.S. Cl.
CPC ..... *E01D 21/00* (2013.01); *E01D 19/125* (2013.01); *E01D 2101/268* (2013.01)

(58) Field of Classification Search
CPC .. E01D 19/125; E01D 21/00; E01D 2101/268
USPC ..... 14/73–78
See application file for complete search history.

(56) References Cited

U.S. PATENT DOCUMENTS 1,665,795 A * 4/1928 Sipe ..... E02D 27/20 175/9
3,706,125 A * 12/1972 Hopkins ..... F16L 1/026 405/157
3,906,571 A 9/1975 Zetlin
4,211,504 A 7/1980 Sivachenko
5,771,518 A * 6/1998 Roberts ..... E01D 19/02 14/73.1
6,421,863 B1 * 7/2002 Tiffany ..... E01D 19/005 14/2.4
6,449,791 B1 * 9/2002 Vodicka ..... E01D 19/02 405/231
7,546,656 B2 * 6/2009 Kim ..... E01D 2/00 14/77.3
8,341,788 B2 * 1/2013 Kim ..... E01D 19/00 14/77.3
8,870,890 B2 10/2014 Aschmann et al.
9,856,614 B1 1/2018 Jiang et al.
9,970,166 B2 5/2018 Aston et al.
11,319,679 B2 5/2022 Vanaman
2007/0163058 A1 7/2007 Homsi
2011/0016645 A1 1/2011 Porter
(Continued)

FOREIGN PATENT DOCUMENTS

GB 2390102 12/2003

*Primary Examiner* — Raymond W Addie
(74) *Attorney, Agent, or Firm* — Head, Johnson, Kachigian & Wilkinson, PC

(57) ABSTRACT

The bridge construction system and method according to the present invention provides a lightweight, efficient, economical, long-lasting, and easily implemented composite steel structure that can be filled with concrete in place for the construction bottomless bridges. The bridge construction system of the present invention is unique in that it is a steel-frame reinforced composite bottomless bridge with decking that provides a permanent, non-removable form for poured-in-place concrete. The composite nature of the bridge allows for installation of the bridge to take place in one day, while the entire process from site preparation such as grading and excavation to cleanup takes a week or less. The quick installation of the bridge is designed to have a minimally invasive impact on the surrounding environment.

10 Claims, 5 Drawing Sheets

(56) References Cited

U.S. PATENT DOCUMENTS

2021/0017722 A1* 1/2021 Stancescu ..... E01D 2/04
2021/0363709 A1* 11/2021 Nelson ..... E04C 3/294

* cited by examiner

BOTTOMLESS BRIDGE CONSTRUCTION SYSTEM AND METHOD

CROSS REFERENCE

Not Applicable.

BACKGROUND OF THE INVENTION

Field of the Invention

This invention relates generally to a bridge construction system and method and more particularly to a modular and composite bottomless bridge construction system and method.

Description of the Related Art

Traditionally, prior art bridges for which the present invention is meant to replace are found in rural areas or are smaller bridges typically around forty feet in length and under. Most of these exist on county roads in rural areas where the age of these bridges is typically reaching the end of their intended life cycle and the condition of the bridge is deteriorating. Depending on whether the bridge is a rated or non-rated bridge typically determines how these types of bridges are constructed. For a rated bridge, meaning that it is approved to hold a specific amount of weight, construction typically consists of cast-in-place or precast concrete structures, steel structures, or wood/timber structures. Those building materials are the typical materials used for such rural bridges. For non-rated bridges, the building materials may consist of the same materials, but also often consist of culverts or sometimes even more questionable materials such as old railroad cars with the ends cutoff. Culverts are typically constructed from a variety of materials including cast-in-place or precast concrete, steel, aluminum, or even plastic.

The construction of these types of bridges is often difficult, inefficient, expensive, and time-consuming. Construction of these bridges can often have a heavy environmental impact on the construction area. Due to the nature of the design, many of the prior art types of bridges contain debris catchments which provide areas for debris to get caught up when water is flowing through. This can lead to decreased flow volume for water to flow through the bridge or culvert, as well as the requirement for maintenance to clear up the debris. These prior art designs also typically provide areas of erosion and washout which can lead to failure of the bridge. Hydrodynamic or bridge scour is also an often an ever present issue that can cause bridge failure with these designs. Due to these issues, there are often high maintenance costs associated with these prior art bridges.

For the foregoing reasons, there is a need for new and unique bridge construction system and method that overcomes the inefficiencies and problems with the prior art bridges that is quick and easy to install, lightweight, long-lasting, and cost-effective.

U.S. Pat. No. 11,319,679 describes such a bridge construction system and method comprising a plurality of hollow abutment walls, a plurality of hollow wing walls or head walls, a plurality of lower steel beams, a plurality of steel scour edge beams, a plurality of lower rebar mats, a plurality of scour edge beam rear cages, a plurality of upper steel tub girders, a plurality of upper decking panels, and a plurality of upper rebar mats. The resulting bridge has a deck, a bottom over which the water, if present, flows, and walls that extend from the deck to the bottom.

There is a further need for a similar new and unique bridge construction system and method that similarly overcomes the inefficiencies and problems with the prior art bridges and that is quick and easy to install, lightweight, long-lasting, and cost-effective, but that also allows for a bottomless bridge construction.

SUMMARY OF THE INVENTION

In general, in a first aspect, the invention relates to a bridge construction system and method that satisfies the foregoing needs. The bridge construction system and method according to the present invention provides a lightweight, efficient, economical, long-lasting, and easily implemented composite steel structure that can be filled with concrete in place for the construction of a bottomless bridge.

The bridge construction system of the present invention may fill a need in rural areas for a lightweight, long-lasting, cost-effective composite steel structure that can be installed quickly and filled with concrete in place to create a bridge made to last for decades. The bridge construction system of the present invention may be a composite steel structure that is unloaded, erected, and site filled with concrete to build a bridge that is capable of meeting certain design standards. The bridge construction system of the present invention is designed to meet American Association of State Highway Transportation Officials loading standards (AASHTO HL-93) or reduced design standards if the system is being used for a pedestrian bridge. The design of the present invention may be a completely open flowway so that it does not include any debris catchments, which may help to significantly increase flow volume, as well as provide reduced long-term maintenance costs due to not having to deal with the snags and clogs associated with debris catchments. The design of the present invention may also provide for significantly increased flow capacity over traditional prior art designs, specifically when compared to traditional round culverts. The design of the present invention may also help to decrease erosion and washout opportunities when compared to prior art designs due to its open flowway. The design of the present invention may provide a bottomless bridge, in that it does not have lower steel beams, steel scour edge beams, lower rebar mats, or scour edge beam rebar cages.

The bridge construction system of the present invention is unique in that it is a steel-frame reinforced composite bottomless bridge with decking and rebar caging that provides a permanent, non-removable form for poured-in-place concrete. The composite nature of the bridge allows for installation of the bridge to take place in one day, while the entire process from site preparation such as grading and excavation to cleanup takes a week or less. The quick installation of the bridge is designed to have a minimally invasive impact on the surrounding environment.

The bridge construction system of the present invention may comprise a plurality of piers that act as the foundation of the bridge, two steel abutment boxes, a plurality of upper steel tub girders, a plurality of upper decking panels, a plurality of upper rebar mats, and any required fasteners to connect the various bridge components. The bridge construction system of the present invention may specifically omit lower steel beams, steel scour edge beams, lower rebar mats, and scour edge beam rebar cages. The bridge construction system of the present invention may additionally omit wing walls and head walls. The bridge construction system of the present invention may not require setting blocks or wallpads.

The steel abutment boxes may be designed to be hollow so that they can be infilled with concrete when concrete is poured to create the bridge. Therefore, the boxes may act as a form for the poured-in-place concrete. Further, all steel components that are exposed to earth and water may be covered with a finish for corrosion resistance as well and environmental and wildlife concerns.

The method of constructing the bridge construction system of the present invention may comprise the below listed steps.

The first step may be preparing the site where the bridge construction system is to be installed, which may comprise demolition of previous infrastructure, if applicable, excavation, and bridge base preparation. Specifically, bridge base preparation may comprise drilling and pouring piers on both sides of the span.

The second step of the present invention may be to cut and level abutment locations on both sides of the span.

The third step may comprise the installation/setting of the steel abutment boxes and braces. The far abutment box may be set, braced, and leveled and then the near abutment box may be set, braced, and leveled.

The fourth step may comprise the installation/setting of the plurality of upper steel tub girders.

The fifth step may comprise the installation/setting of the plurality of upper decking panels.

The sixth step may comprise the installation of the upper rebar mats.

The seventh step may comprise the pouring of the concrete where necessary, including the infilling of the composite steel structure of the present invention.

The eighth step may comprise cleaning up of the site.

Steps two through seven of the method for constructing the bridge construction system of the present invention have specifically been designed to be able to be finished in one day, while the entire process may be finished in a week or less.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a bottomless bridge construction system and method.

Figure 1:
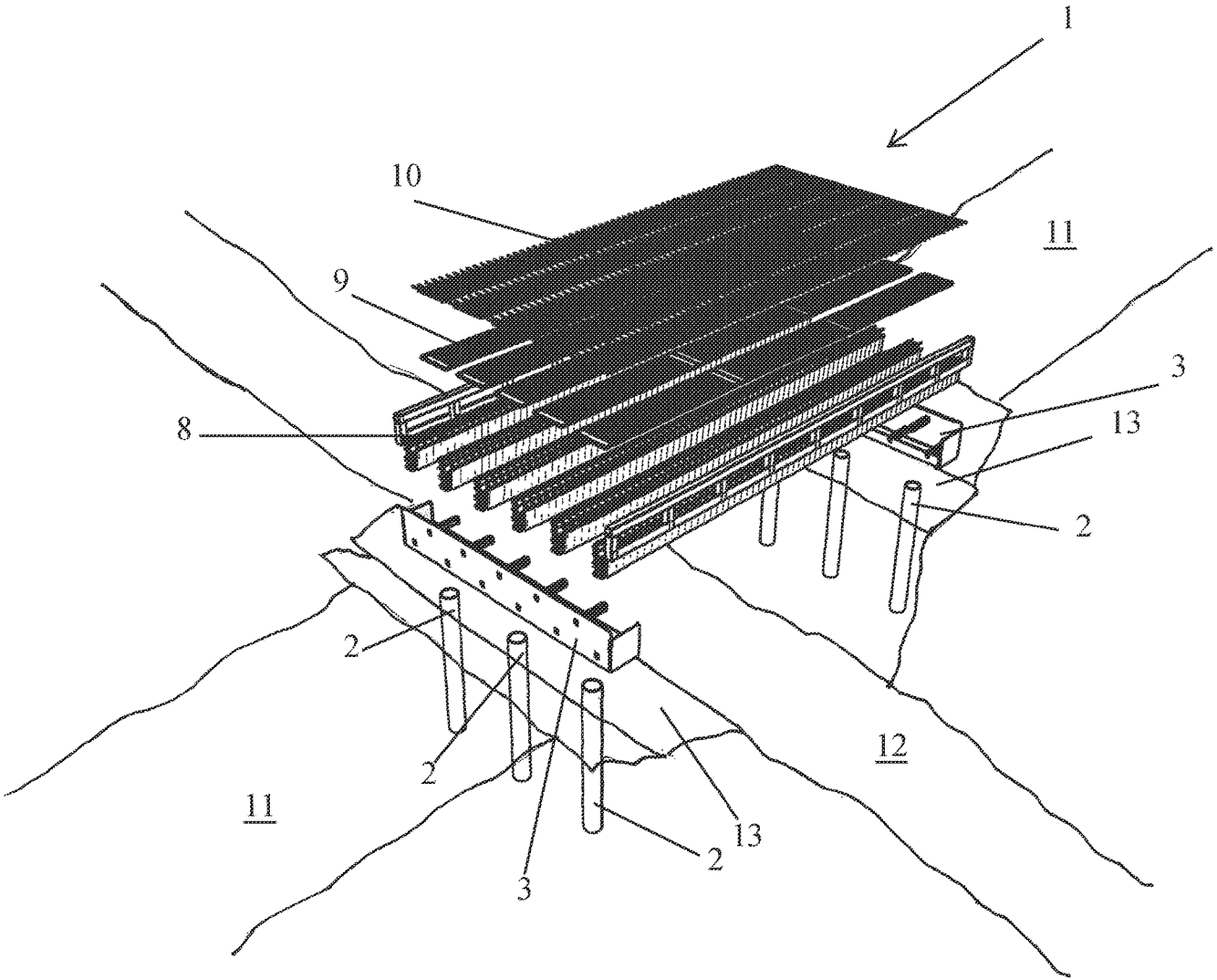
FIG. 1 is an exploded perspective view of a bridge construction system of the present invention.
Figure 2:
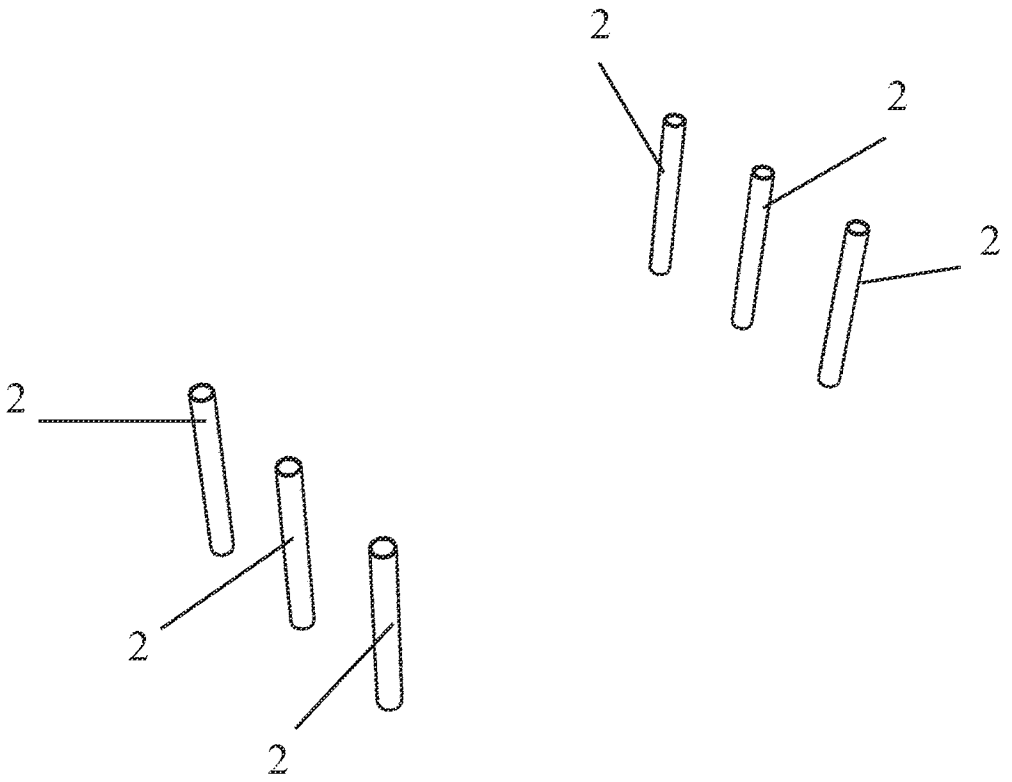
FIG. 2 is a perspective view of the first step of the method of the present invention.
Figure 3:
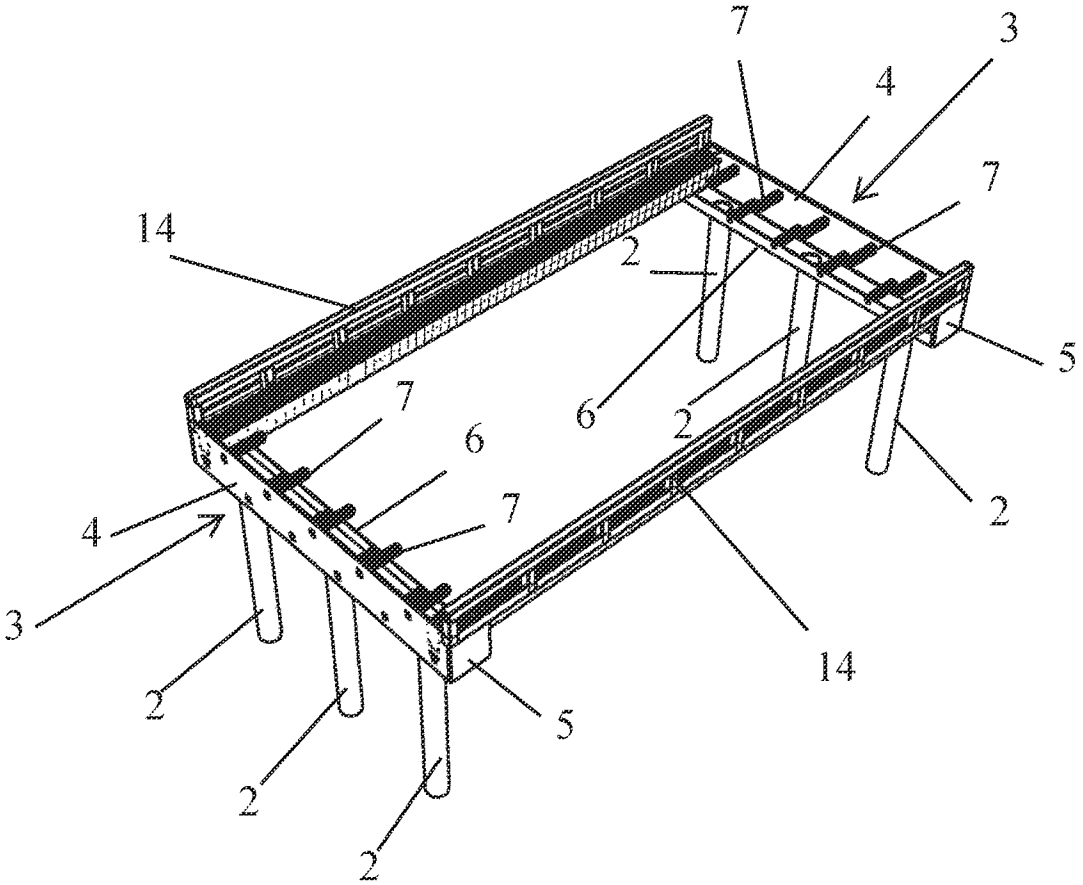
FIG. 3 is a perspective view of the third step of the method of the present invention.
Figure 4:
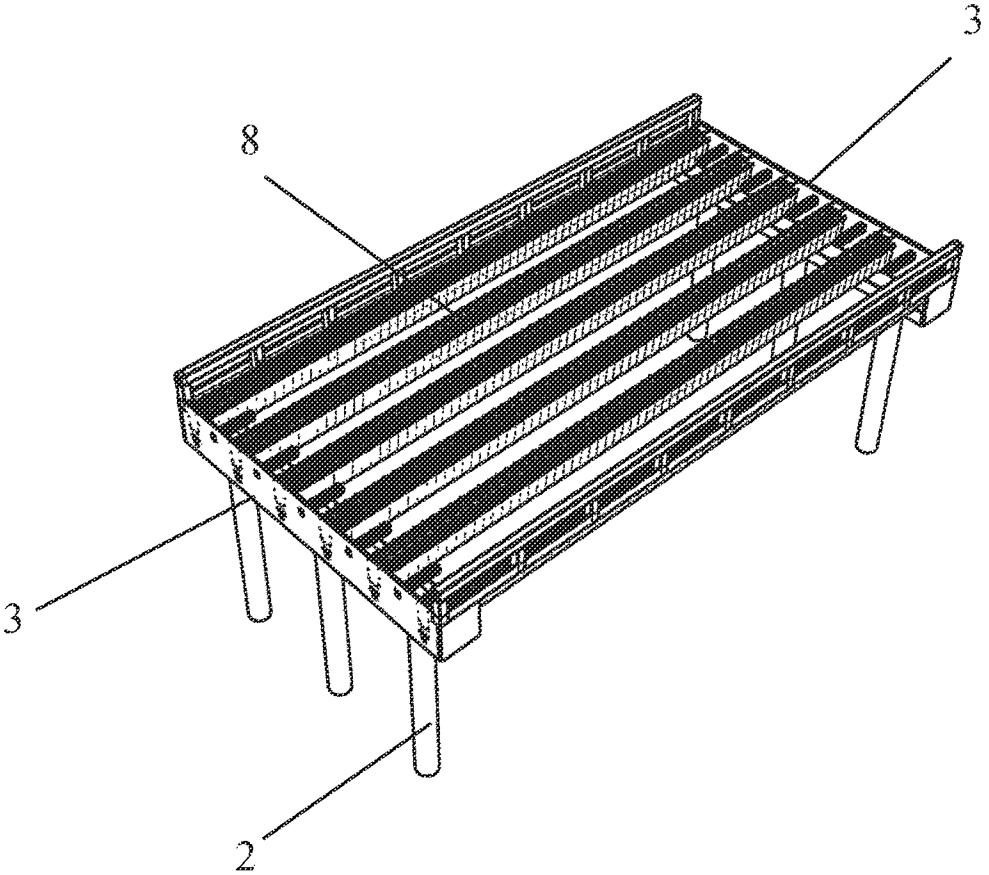
FIG. 4 is a perspective view of the fourth step of the method of the present invention.
Figure 5:
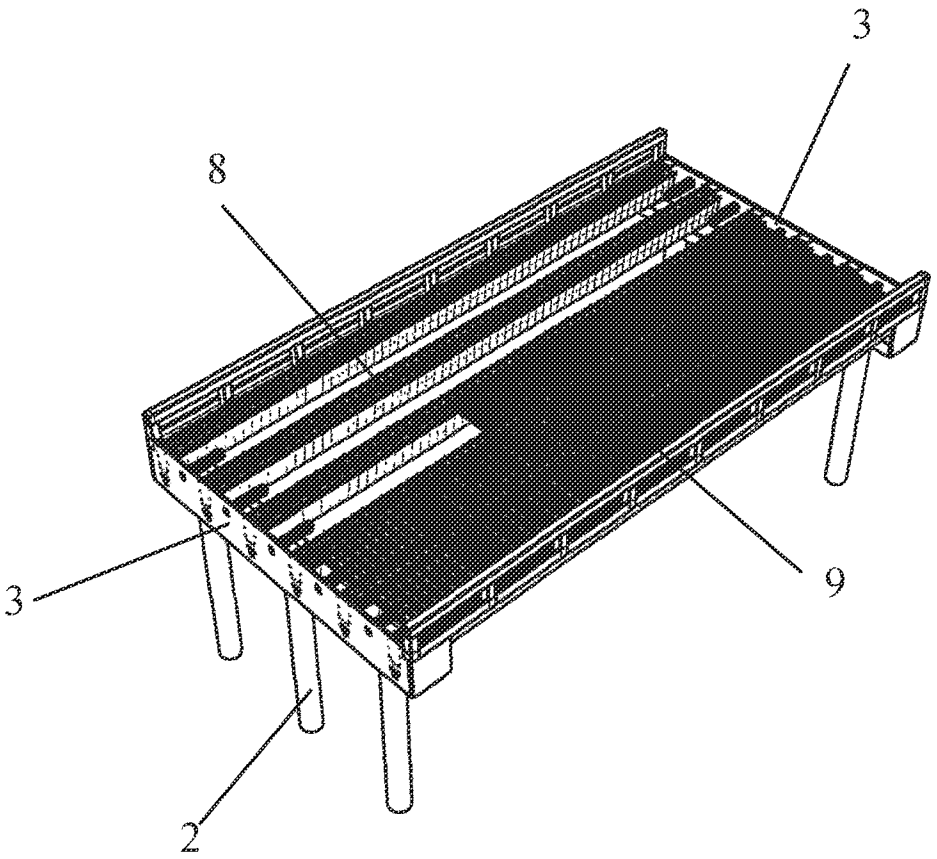
FIG. 5 is a perspective view partway through the fifth step of the method of the present invention.

Referring now to the drawings, reference will be made to the preferred embodiment of the invention, an example of which is illustrated in the accompanying drawings and not meant for purposes of limiting the scope of the present invention. With reference to FIG. 1, it is generally shown a bridge construction system 1 of the present invention, depicting various components comprising said system. The bridge construction system 1 of the present invention may comprise a plurality of drilled and poured piers 2 that act as the foundation of the bridge, two hollow steel abutment boxes 3, a plurality of upper steel tub girders 8, a plurality of upper decking panels 9, a plurality of upper rebar mats 10, and any means for fastening the various components as needed. The bridge construction system 1 my be installed along the path of a roadway 11 spanning a waterway 12 or other area lower than the roadway 11.

The bridge construction system of the present invention may specifically omit lower steel beams, steel scour edge beams, lower rebar mats, and scour edge beam rebar cages. The bridge construction system of the present invention may additionally omit wing walls and head walls. The bridge construction system of the present invention may not require setting blocks or wallpads.

The abutment boxes 3 of the present invention may be fully reinforced. Each may comprise a back wall 4, two side walls 5, a front wall 6, and a plurality of projections 7. The side walls 5 may project perpendicularly from each end of the back wall 4 in the direction of the waterway 12 when the abutment box 3 is in place. The front wall 6 may span the two side walls 5 in parallel to the back wall 4, but may be shorter than the back wall 4. Specifically, the front wall may be no more than ½ of the height of the back wall 4. The plurality of projections 7 may similarly project perpendicularly from the back wall 4 in the direction of the waterway 12 when the abutment box 3 is in place, and may be placed at various intervals along the length of the abutment box 3.

The bridge construction system of the present invention is unique in that it is a steel-frame reinforced composite bottomless bridge with decking that provides a permanent, non-removable form for poured-in-place concrete. The composite nature of the bridge may allow for installation of the bridge to take place in one day, while the entire process from site preparation such as grading and excavation to cleanup may take a week or less. The quick installation of the bridge is designed to have a minimally invasive impact on the surrounding environment. Further, all steel components that are exposed to earth and water may be covered with a finish for corrosion resistance as well and environmental and wildlife concerns. Such a finish may be a zinc flame spray or a zinc primer, among other options.

The bridge construction system of the present invention is intended to provide various design options to customers dependent on their needs. For example, the steel abutment boxes may be available in heights of 6 feet, 8 feet, 10 feet, or 15 feet, or any other desired height. Further, the bridge construction system may cover roadway widths from 20 feet up to 38 feet or any other desired width in two-foot increments or any other desired increments. The bridge construction system may cover a span of a waterway from 15 feet to 40 feet or any other desired span in five-foot increments or any other desired increments. Also, dependent on the type of bridge and the needs of the customer, various options are available for the traffic way sides of the bridge, from standard curb design, to modified k-rail design, guardrail support, or even an ADA compliant guardrail for pedestrian bridges.

The bridge construction system may be used to produce a skewed bridge. Due to the modular nature of the bridge construction system, additional abutment boxes may be added to produce a multi-span bridge capable of spanning a wider waterway.

The method for constructing the bridge construction system 1 of the present invention is depicted in FIG. 2 through FIG. 8. The method of construction may comprise the following steps. The first step may be preparing the site where the bridge construction system 1 is to be installed, which may comprise demolition of previous infrastructure, if applicable, excavation, and bridge base preparation. Specifically, bridge base preparation may comprise drilling and pouring piers 2 on both sides of the span.

The second step of the present invention may be to cut and level abutment locations 13 on both sides of the span. The abutment locations 13 may be located nearer the roadway 11 than the base of the waterway 12.

The third step may comprise the installation/setting of the steel abutment boxes 3 and braces. The far abutment box 3 may be set, braced, and leveled and then the near abutment box 3 may be set, braced, and leveled. The abutment boxes 3 may be set directly on the ground in the abutment locations 13, directly above the piers 2. The abutment boxes 3 may not extend all the way down to the base of the waterway 12.

The fourth step may comprise the installation/setting of the plurality of upper steel tub girders 8. The fifth step may comprise the installation/setting of the plurality of upper decking panels 9. The sixth step may comprise the installation of the upper rebar mats 10.

The seventh step may comprise the pouring of the concrete where necessary, including the infilling of the composite steel structure of the present invention, specifically the infilling of the abutment boxes 3. Concrete may also be poured over the upper rebar mats 10 and decking 9. The final step may comprise site cleanup.

Optionally, a tube steel barrier system 14 may be included in the bridge construction system 1.

Whereas, the devices and methods have been described in relation to the drawings and claims, it should be understood that other and further modifications, apart from those shown or suggested herein, may be made within the spirit and scope of this invention.

What is claimed is:

1. A bridge construction system comprising:

a plurality of abutment boxes, wherein said abutment boxes are hollow and where each of the plurality of abutment boxes comprises a back wall, two side walls, and a front wall, where the front wall is parallel to and shorter than the back wall;

a plurality of upper steel tub girders;

a plurality of upper decking panels; and a plurality of upper rebar mats.

2. The bridge construction system of claim 1, wherein the abutment boxes come in heights of 5 foot, 8 foot, 10 foot, or 15 foot.

3. The bridge construction system of claim 1, wherein the abutments boxes are 4 foot wide by five foot deep and modular for roadway width.

4. The bridge construction system of claim 1, wherein said bridge construction system is designed to be capable of spanning a waterway from a width of 30 feet up to 60 feet in increments of 5 feet.

5. The bridge construction system of claim 1, wherein said bridge construction system is designed to be capable of being built to cover roadway widths from 20 feet up to 28 feet or wider.

6. The bridge construction method of claim 1, wherein said abutment boxes are made of steel and are covered in a corrosion resistant finish to provide maximum longevity of the steel and to protect against negative environmental and wildlife impacts.

7. The bridge construction method of claim 5 wherein said corrosion resistant finish is a polymide epoxy or galvanized.

8. The bridge construction system of claim 1, wherein various edge options are available for the traffic way sides of the bridge, including a standard curb design, a modified k-rail design, guardrail support, or even an ADA compliant guardrail for pedestrian bridges.

9. The bridge construction system of claim 1, wherein said bridge construction system meets American Association of State Highway Transportation Officials loading standards (AASHTO HL-93).

10. A method of constructing a bridge construction system, said method comprising the steps of:

b. installing hollow steel abutment boxes, where each of the hollow steel abutment boxes comprises a back wall, two side walls, and a front wall, where the front wall is parallel to and shorter than the back wall;

c. installing a plurality of upper steel tub girders;

d. installing of a plurality of upper decking panels;

e. installing a plurality of upper rebar mats; and f. pouring of concrete over the plurality of upper rebar mats and infilling the hollow portions of the hollow steel abutment boxes.

* * * * *